US005903937A

United States Patent [19]

Clarke

[11] Patent Number: 5,903,937

[45] Date of Patent: May 18, 1999

[54] BATHROOM MODULE ACCESSIBLE TO WHEELED ASSEMBLIES

[75] Inventor: Richard E. Clarke, Auburn, Wash.

[73] Assignee: Amtech Corporation, Yelm, Wash.

[21] Appl. No.: 08/820,157

[22] Filed: Mar. 19, 1997

[51] Int. Cl.[6] ..... A47K 4/00

[52] U.S. Cl. ..... 4/663; 52/34

[58] Field of Search ..... 4/662–664, 679–681, 4/640, 642, 650, 653; 52/34, 302.3

[56] References Cited

U.S. PATENT DOCUMENTS

| | | | |
|---|---|---|---|
| 1,978,842 | 10/1934 | Hooton | 189/1 |
| 2,419,319 | 4/1947 | Lankton | 20/2 |
| 2,712,863 | 7/1955 | Busch | 4/663 |
| 3,047,106 | 7/1962 | Callahan | 189/1 |
| 3,110,907 | 11/1963 | King | 4/2 |
| 3,148,380 | 9/1964 | Hanson | 52/34 |
| 3,590,393 | 7/1971 | Hollander et al. | 4/2 |
| 3,755,826 | 9/1973 | Roberts | 4/662 |
| 3,821,818 | 7/1974 | Alosi | 4/191 |
| 3,978,529 | 9/1976 | Krafft | 4/2 |
| 4,142,255 | 3/1979 | Togni | 4/1 |
| 4,221,441 | 9/1980 | Bain | 312/228 |
| 4,622,911 | 11/1986 | Salminen | 114/71 |
| 4,745,712 | 5/1988 | O'Leary | 52/34 |
| 5,438,713 | 8/1995 | Clarke | 4/663 |

OTHER PUBLICATIONS

"LAVTEC™ The Seamless Solution," AMTECH Corporation Brochure, pp. 1–4, undated.

"LAVTEC™ Handicapped–Accessible Unit," AMTECH Corporation Brochure, pp. 1–2, undated.

"LAVTEC™ 5ft x 8ft Hotel/Residential Unit," AMTECH Corporation Brochure, pp. 1–2, undated.

"Modular Marine Bathrooms," Frenkin Corporation Brochure, pp. 1–4, 1984.

"LAVTEC™ Bath & Shower Modules," Jamestown Metal Marine Sales, Inc. Brochure, pp. 1–2, undated.

*Primary Examiner*—Charles R. Eloshway

*Attorney, Agent, or Firm*—Seed and Berry LLP

[57] ABSTRACT

A prefabricated bathroom module for receiving a wheeled assembly such as a wheelchair, a walker, a piece of wheeled cleaning equipment, or the like. In a preferred embodiment, the bathroom module includes two floor surfaces, a first one of which is adapted to receive liquids thereon. The first floor surface that receives the liquids is inclined toward the second floor surface so the liquid is directed toward this second floor surface. A drainage trough is positioned between the first and second floor surfaces for collecting the liquid from the first floor surface and for preventing liquid from moving between the two floor surfaces. The trough contains an aperture and drain for removing liquid collected in the trough. The bathroom module includes at least one bathroom fixture, such as a shower, which may be connected to existing plumbing in the structure in which the module is installed.

19 Claims, 4 Drawing Sheets

BATHROOM MODULE ACCESSIBLE TO WHEELED ASSEMBLIES

TECHNICAL FIELD

The present invention relates to prefabricated module rooms and, more particularly, to prefabricated bathroom modules accessible to wheeled assemblies.

BACKGROUND OF THE INVENTION

Prefabricated bathroom modules have been developed for residential, institutional and commercial buildings to make installation of bathrooms in such structures easier, faster, and less expensive. The modules are substantially self-contained so as to minimize the amount of work required to install the module. Bathroom modules are factory-equipped with a floor, walls, ceiling and bathroom fixtures, such as a toilet, shower, sink and vanity. The modules include plumbing connection points that inter-connect the building's water supply and sewage lines to the fixtures within the module.

In a conventional bathroom module that includes a vanity portion and a shower portion, as is described in U.S. Pat. No. 5,438,713, the vanity portion typically contains cabinets, flooring, and fixtures which are best kept dry. The shower portion, on the other hand, gets wet during normal use or is sprayed with water or other liquids for cleaning. Such bathroom modules also have dams projecting above the floor between the shower portion and vanity portion to prevent water in the shower portion from traversing into and soaking the vanity portion.

One problem with conventional bathroom modules is that the dams prevent wheeled assemblies from moving easily between the vanity portion and the shower portion. Such wheeled assemblies include wheelchairs or walkers required by disabled bathroom module users, as well as wheeled cleaning devices, such as mop buckets and the like.

In one style of a conventional bathroom module, the vanity portion is designed to become wet, for example, for purposes of cleaning. A drawback with this type of bathroom module is that the dam requires drains be installed on each side of the dam to drain the entire bathroom module. The use of two drains can increase the cost of the module and increase the complexity of fabricating the module.

Accordingly, there is a need in this field for a bathroom module which is fully accessible to wheeled assemblies and which does not require installation of two separate drains. The present invention fulfills this need and provides further related advantages.

SUMMARY OF THE INVENTION

In brief, the present invention provides a bathroom module for use with wheeled assemblies such as wheelchairs, walkers, cleaning equipment, and the like. The module is self-contained and may be installed in structures that have existing water supply lines and wastewater removal lines, such as residences, commercial buildings, institutional buildings, ships, and the like.

In one embodiment of the present invention, the bathroom module includes a floor, a wall connected to and extending away from the floor such that the wall and the floor define an interior area, and at least one bathroom fixture housed within the interior area. The floor has first and second floor sections, with the second floor section being adapted to have liquid thereon and being inclined toward the first floor section to direct liquid toward the first floor section.

A trough is positioned between the first and second floor sections for collecting liquid from the second floor section and preventing the liquid from moving between the first and second floor sections. The trough has a drain for draining fluid away from the trough. A bridge extends between the first and second floor sections above the trough and is positioned to allow liquid to move from the second floor section into the trough. The bridge also permits wheeled assemblies to pass across the bridge and over the trough between the first and second floor sections.

In this embodiment of the present invention, the trough extends along the entire length of the first and second floor sections so as to prevent the passage of liquid between the two floor sections. The first and second floor sections are integrally connected with the trough. The integral connection ensures a liquid-tight interface between the trough and the floor sections, thereby reducing the potential for leaks from the module. These and other aspects of this invention will become evident upon reference to the following detailed description and attached drawings.

DETAILED DESCRIPTION OF THE INVENTION

A bathroom module 2 in accordance with one embodiment of the present invention is shown in FIGS. 1–4 for illustrative purposes. The bathroom module 2 is sized and adapted so people using walkers, wheelchairs, or the like can move about within the module. The bathroom module 2 is also designed so wheeled devices, such as cleaning devices, buckets, and the like, can easily be moved all around in the module. The bathroom module 2 is an essentially self-contained unit that is manufactured, shipped to, and installed in a structure, such as a commercial, residential, or institutional building.

Figure 1:
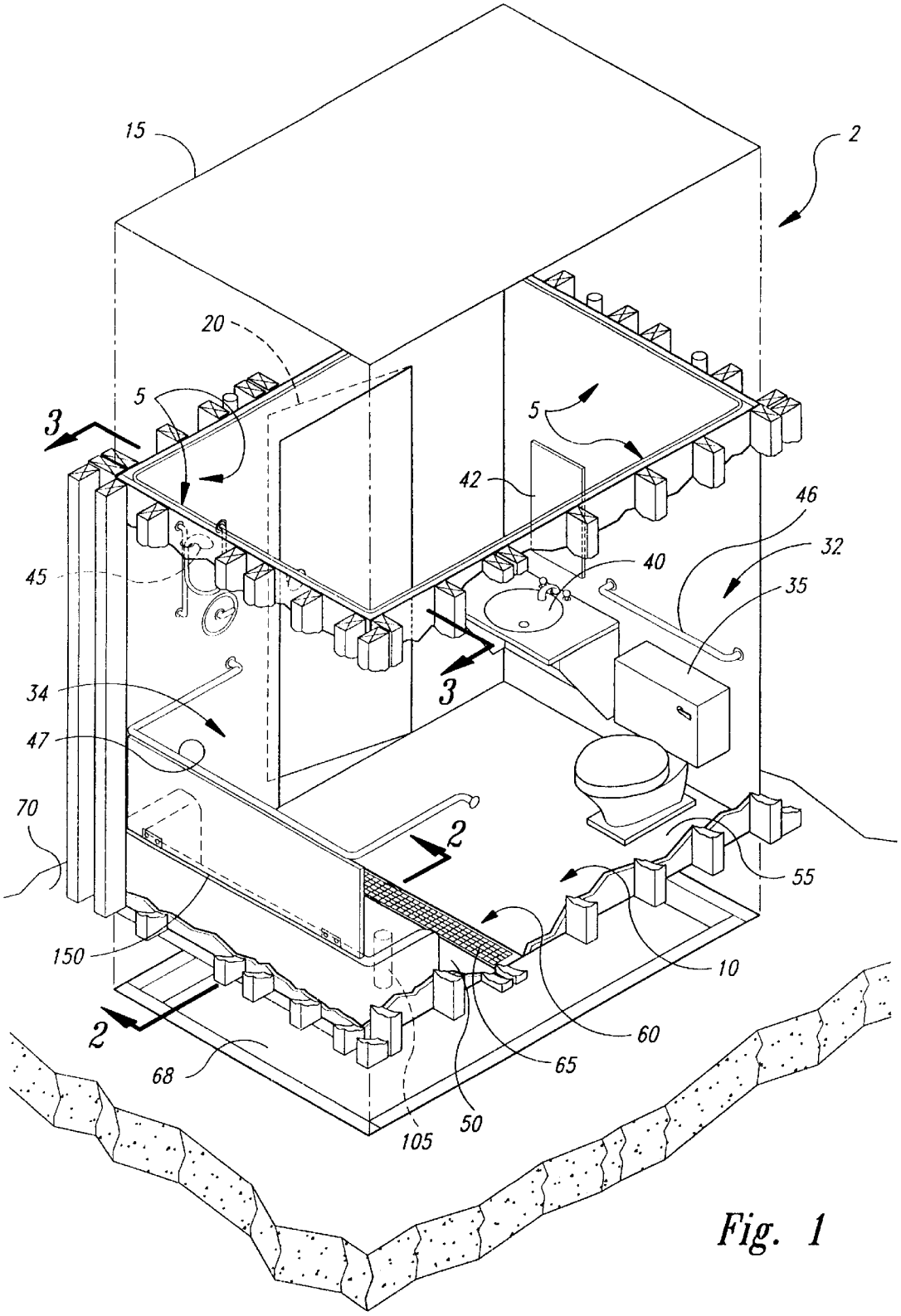
FIG. 1 is an exploded isometric view of a bathroom module in accordance with one embodiment of the present invention with structural wall studs and two walls shown partially broken away for clarity.

As best seen in FIG. 1, the bathroom module 2 includes a module floor 10 connected to four interior walls 5 that are in turn each connected to a ceiling 15. A drainage trough 60 in the module floor 10 collects water from the module floor and directs it to a conventional drain pipe 105 projecting from a floor 70 of the building in which the module is installed. A grate 65 allows users with wheelchairs or other wheeled assemblies to pass freely over the trough 60 as they move about inside the bathroom module 2.

The illustrated bathroom module 2 is positioned in a recessed well 68 formed in the building floor 70 so that the module floor 10 is substantially level with the building floor. Users may then enter and exit the bathroom module 2 through a door 20 located in one of the walls 5 without encountering a step.

The walls 5 and module floor 10 of the illustrated bathroom module 2 define an interior area that includes a vanity area 32 adjacent to a shower area 34. The vanity area 32 includes bathroom fixtures, such as a toilet 35, a sink 40, a handrail 46 and a mirror 42 therein. The toilet 35, sink 40, handrail 46 and mirror 42 are positioned on or over a vanity floor 55 which, in a preferred embodiment, is intended to remain dry when the bathroom module 2 is in use.

The shower area 34 is opposite the vanity portion 32 and contains bathroom fixtures such as a shower head 45, a folding bench seat 150 and a hand rail 47. The shower head 45, hand rail 47, and folding bench seat 150 are positioned above a shower floor 50 that is spaced apart from the vanity floor 55. During normal use, the shower floor 50 becomes soaked with water when the user runs water through the shower head 45.

The shower floor 50 and vanity floor 55 are separated from each other by the trough 60 that is connected to each of the shower and vanity floors and that is positioned to collect water draining from the shower floor. As shown in greater detail in FIG. 2, the shower floor 50 is inclined toward the trough 60 in order to direct liquid from the shower floor into the trough. The shower floor 50 is sufficiently inclined to prevent water from pooling thereon, but is not so steeply inclined as to cause wheeled assemblies such as wheelchairs, walkers, and cleaning equipment to roll unintentionally toward the trough 60. In one embodiment, the shower floor 50 is inclined at a grade of between approximately 1% and 4%, inclusive, toward the trough 60 and is preferably inclined at approximately 2%. As used herein, a grade of approximately 2%, as an example, is one for which the tangent of the angle between the shower floor portion and horizontal is 0.02. Other grades which satisfactorily drain liquid from the shower floor 50 and do not cause the wheeled assemblies to roll unintentionally are used in alternate embodiments.

Figure 2:
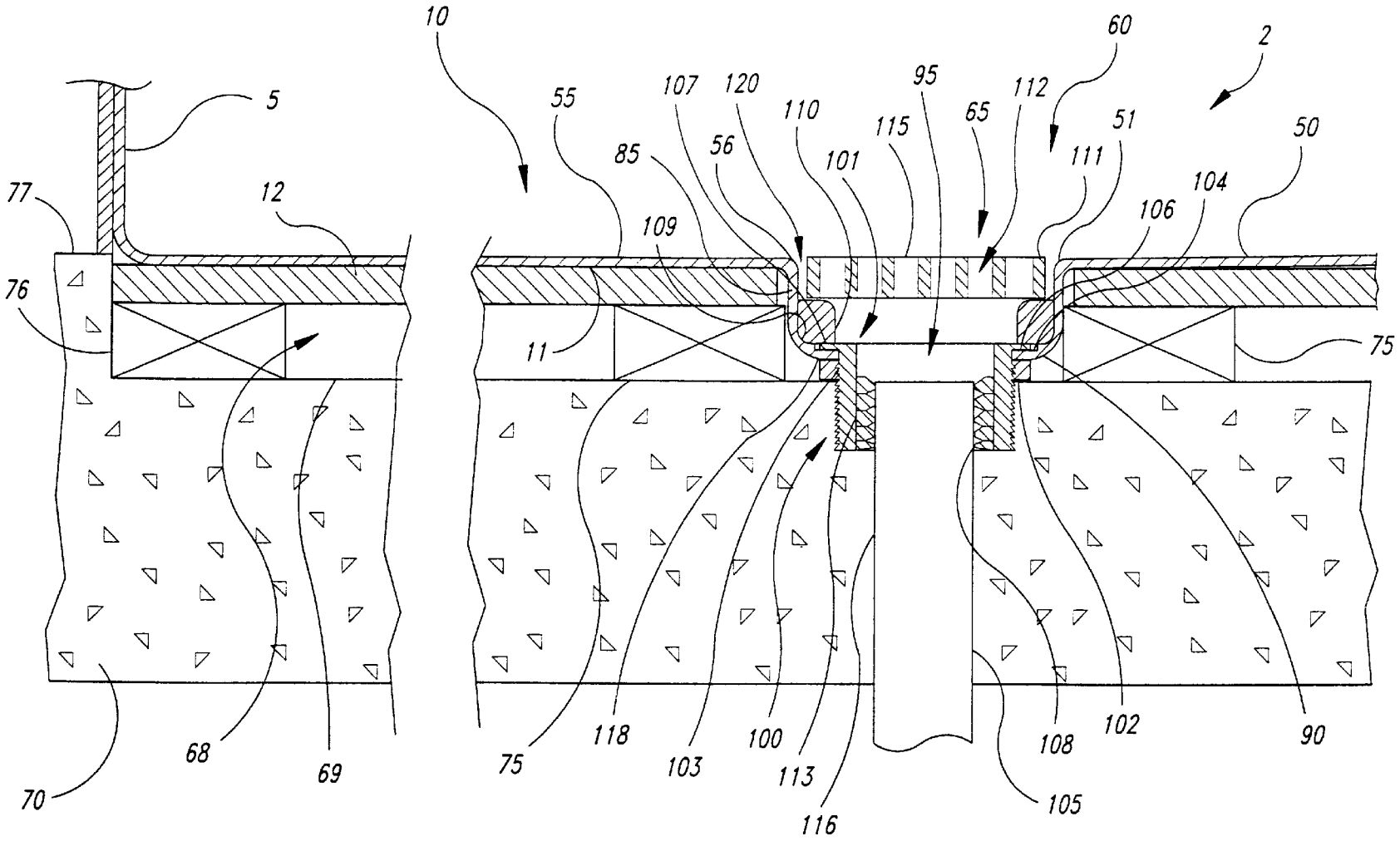
FIG. 2 is an enlarged broken detailed cross-sectional view taken substantially along line 2—2 of FIG. 1 showing a trough projecting beneath a floor of the bathroom module.

Although only the shower floor 50 in the embodiment shown in FIG. 2 is inclined toward the trough 60, the vanity floor 55 in an alternate embodiment is inclined toward the trough 60 as well. This alternate embodiment permits liquids to be easily removed from the vanity portion 55 if, for example, the vanity floor portion is cleaned by spraying it with water or other liquids. Such an arrangement is particularly suitable when the vanity floor 55 is designed to undergo such a cleaning technique. An advantage of the trough 60 of the present invention is that in this alternate embodiment, a single trough is positioned to drain liquid from multiple sections of the module floor 10.

As shown in FIG. 2, the module floor 10 is reinforced with a backing 12, such as plywood. Peripheral support members 76 line the periphery of the recessed well 68 and support the module floor 10 and the backing 12 in a raised position above a lower surface 69 of the recessed well 68. The peripheral support members 76 are sized such that the module floor 10 is flush with an adjoining edge 77 of the floor 70. In this manner, the wheeled assemblies may pass into and out of the bathroom module 2 without encountering a step.

Internal support members 75 also support the plywood backing 12 and the module floor 10 in a raised position above the lower surface 69 of the recessed well 68. The internal support members 75 are of sufficient height that the trough 60 does not contact the lower surface 69 when the bathroom module 2 is installed in the recessed well 68. Therefore, when the bathroom module 2 is installed, the weight of the bathroom module is borne by the support members 75 and 76 rather than by the trough 60.

As best seen in FIG. 2, the trough 60 extends downwardly from a lower surface 11 of the module floor 10. The trough 60 has a generally U-shaped cross section defined by sidewalls 85 and a trough base 90 extending between the sidewalls. The sidewalls 85 are integrally connected to and project downwardly from a respective one of the vanity floor 55 and the shower floor 50 and integrally connect to the trough base 90. The trough base 90 is positioned below a vanity floor edge 56 and a shower floor edge 51 in order to receive water from the shower floor 50 and prevent water from passing between the shower floor and the vanity floor 55.

In alternate embodiments of the present invention, the geometry of the trough 60 is varied. For example, in one such embodiment, the sidewalls 85 are inclined toward each other, and may be sufficiently inclined so as to eliminate the need for the trough base 90. Other embodiments include further modifications of the trough sidewalls 85 and trough base 90, while maintaining a portion of the trough below the level of the shower and vanity floors 50 and 55 to collect liquid therefrom.

In a preferred embodiment, the components of the trough 60, including the sidewalls 85 and trough base 90, are formed integrally with the vanity floor 55 and the shower floor 50. By integrally forming the components of the trough 60 with each other and with the floors, the present invention minimizes the potential for leaks at the interfaces between the components.

Figure 3:
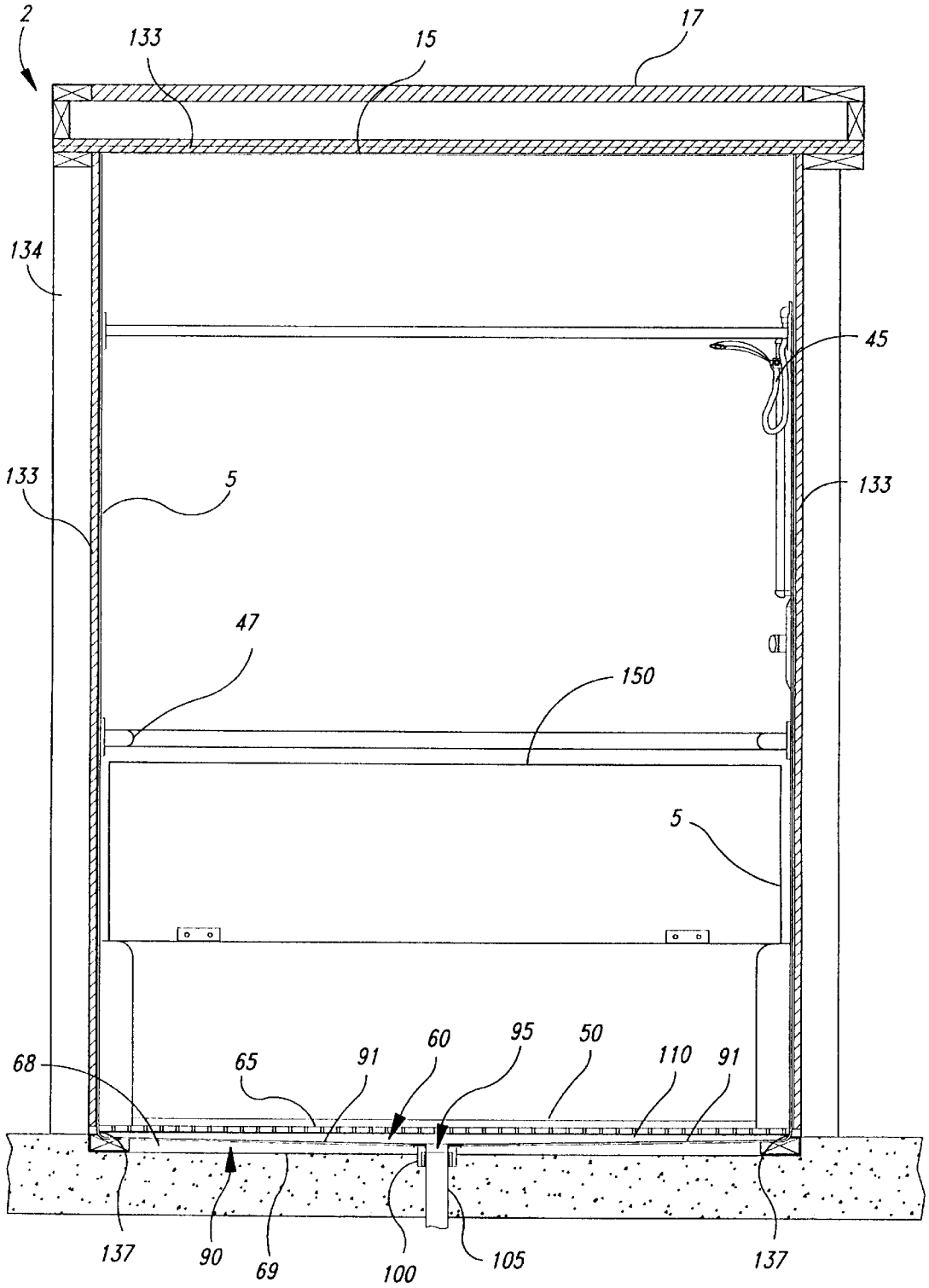
FIG. 3 is an enlarged cross-sectional view taken substantially along line 3—3 of FIG. 1 showing a trough in accordance with the present invention sloping toward a drain pipe.

In a preferred embodiment of the invention, the trough 60 extends the full distance between opposing interior walls 5 and is joined to both opposing interior walls, as shown in FIG. 3. This arrangement ensures that the entire shower floor 50 drains into the trough 60. In a further aspect of the preferred embodiment, opposing ends 137 of the trough 60 are formed integrally with the interior walls 5 so as to minimize the potential for leaks at the joints between the trough and the interior walls.

In a further aspect of this embodiment, the components of the trough 60 are formed integrally with the walls 5 which are in turn formed integrally with the ceiling 15, resulting in a one-piece, sealed unit which further reduces the potential for leaks. In this embodiment, the bathroom module 2 comprises a single fiberglass lay-up. In another embodiment, materials such as plastics and other suitable materials known to those skilled in the art are used to form the walls 5, ceiling 15, module floor 10, and trough 60 of the bathroom module 2.

As best seen in FIG. 3, the trough base 90 has two opposing sloped portions 91. The sloped portions 91 each slope downwardly away from an opposing wall 5 toward the center of the trough 60 and the drain pipe 105 to move liquid contained within the trough toward the drain pipe. In a preferred embodiment of the invention, the trough base 90 is inclined toward the drain pipe 105 at approximately a 2% grade. The 2% grade is shallow enough to prevent the trough 60 from interfering with the lower surface 69 of the recessed well 68, but is steep enough to drain liquid from the trough into the drain pipe 105. Other embodiments include grades such as in the range of approximately 1%–4%, or other grades, shallow enough to prevent the trough 60 from interfering with the lower surface 69, but sufficiently steep so as to drain liquid from the trough into the drain pipe 105.

The trough 60 is joined to the drain pipe 105 with a drain assembly 100, as best seen in FIG. 2. The drain assembly 100 includes a hollow, cylindrical drain 101 having a lip 106 extending around the periphery of one end of the drain, and having external threads 103 located beneath the lip. The drain 101 extends through a drain aperture 95 in the base 90 of the trough 60 such that the lip 106 engages an upper side 104 of the trough base around the drain aperture and the external threads 103 are positioned below a lower side 118 of the trough base.

The drain 101 is securely retained in place by a nut 102 that is tightly threaded onto the external threads 103 of the drain, thereby clamping the trough base 90 between the lip 106 and the nut. The lip 106 is tightly secured against the trough base 90 so as to form a liquid-tight seal, which prevents liquid from leaking between the drain aperture 95 and the drain pipe 105. In a preferred embodiment of the trough 60, a region of the trough base 90 surrounding the lip 106 is recessed so that an upper surface 107 of the lip is substantially flush with an adjacent portion 109 of the trough base, thereby minimizing the tendency for liquid to pool in the trough around the drain 101.

The drain 101 includes a plurality of flexible internal grommets 108, which are sized to tightly engage both the interior walls 113 of the drain and an outer surface 116 of the drain pipe 105. The internal grommets 108 sealably engage the drain pipe's outside surface 116, so the water passing through the drain 101 is directed into the drain pipe, rather than leaking along the drain pipe's outer surface.

When the bathroom module 2 is installed in the recessed well 68, the module is positioned so the drain assembly 100 is directly above the drain pipe 105. The bathroom module 2 is then lowered into the recessed well 68, such that the drain 101 extends over the drain pipe 105 and the grommets 108 slide along the outer surface 116 of the drain pipe to form a fluid-tight seal between the drain and the drain pipe. The drain pipe 105 is connected to the existing plumbing network in the building in which the bathroom module 2 is installed so that water collected by the trough 60 and directed through the drain assembly 100 and the drain pipe 105 is further directed to the building's plumbing network and away from the bathroom module.

As discussed above, the trough 60 includes a grate 65 which allows wheeled assemblies to pass easily over the trough. In a preferred embodiment, the grate 65 is supported above the trough base 90 by shoulders 110 which are formed integrally with the trough sidewalls 85 and which project inwardly from the trough sidewalls toward the center of the trough 60 as shown in FIGS. 2 and 3. The shoulders 110 support the grate 65 such that an upper surface 115 of the grate is flush with both the adjoining vanity floor edge 56 and the opposing shower floor edge 51 so that the wheeled assemblies may pass between the shower and vanity floors 50 and 55 over the grate substantially without encountering a step. The grate 65 is sized so a gap 120 is provided between the grate and the floor edges 51 and 56, and the gap allows liquids to pass between the grate and the floor edges and into the trough 60. The gap 120 is sufficiently narrow so as not to entrap the wheels of wheeled assemblies when the wheeled assemblies pass over the grate.

Figure 4:
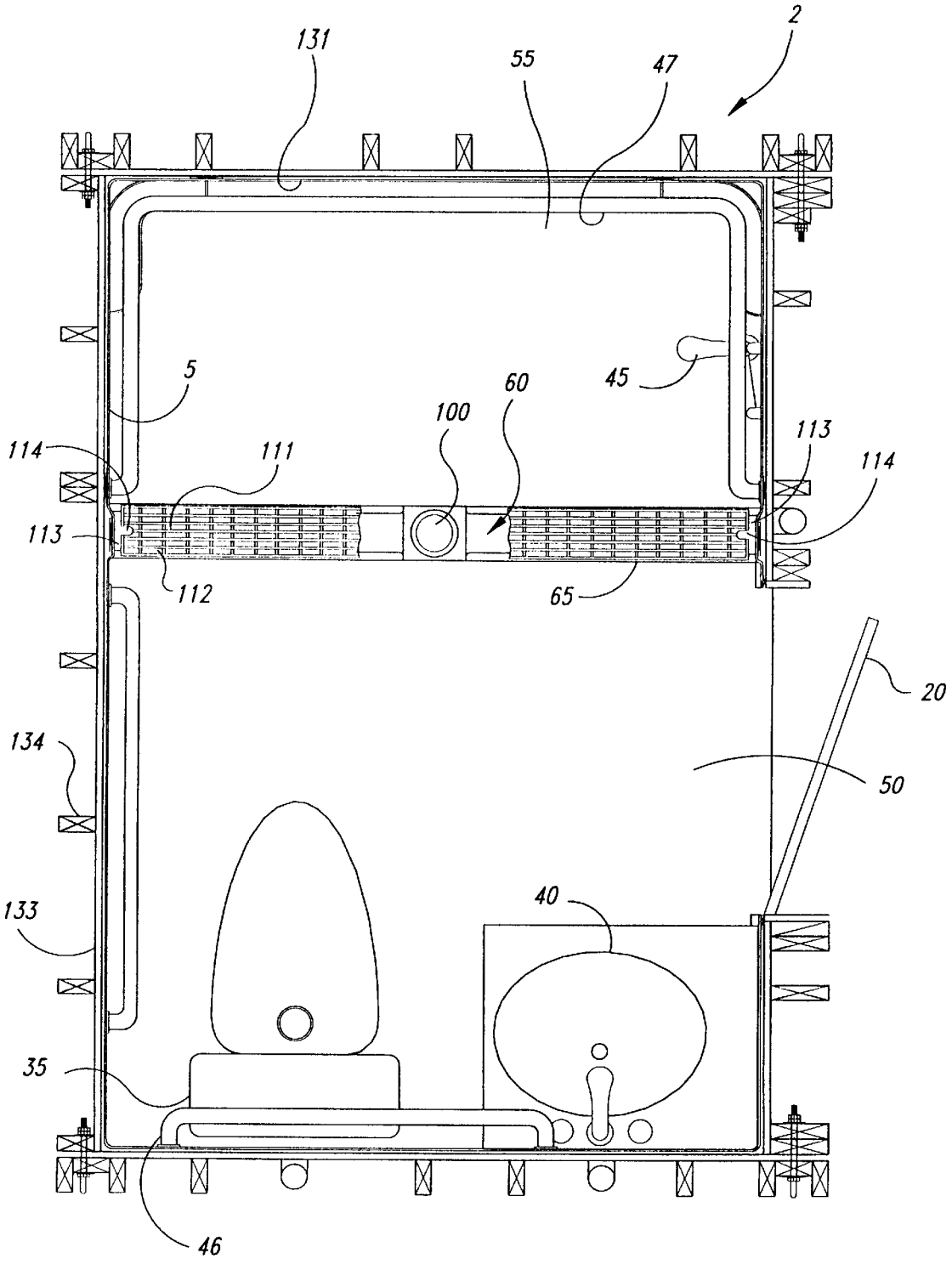
FIG. 4 is an enlarged plan view of the bathroom module of FIG. 1, with a bridge over the trough shown partially broken away.

As shown in FIGS. 2 and 4, the grate 65 comprises a network of orthogonal webs 111 which interconnect to form a network of lattice apertures 112. The webs 111 are configured to support the weight of the wheeled assemblies and persons which pass over the grate 65. In a preferred embodiment, the lattice apertures 112 in the grate 65 are large enough to permit water and other liquids to pass easily through the grate and into the trough 60 below, and are small enough that they do not entrap or otherwise obstruct the wheels of wheeled assemblies which pass over the grate. The lattice apertures 112 are sized and distributed such that they do not unacceptably compromise the structural integrity of the grate 65 by causing it to bend excessively or break under load.

In a preferred embodiment, the grate 65 is formed from steel, the lattice apertures are 2.0 inches long and 0.5 inches wide, and the webs 111 are 0.75 inches deep and 0.25 inches thick. Other grate materials, web dimensions, and web spacings which also support the weight of devices and people that pass over the grate 65 will be readily apparent to those skilled in the art. In further alternate embodiments, the lattice apertures 112 are not rectangular, as shown in FIG. 4, but assume any number of a wide variety of shapes such as circular, square, triangular or the like.

As shown in FIG. 4, the grate 65 includes finger holes 114 which a user may easily engage to remove the grate. The user may wish to periodically remove the grate 65 to access the trough 60 for cleaning or for removal of foreign materials, and to easily clean or replace the grate. In a preferred embodiment, the grate 65 is sized to leave a small gap 113 between the grate and the walls 5 so that the grate may be removed without rubbing it against the walls. In an alternate embodiment, the grate 65 is removably secured to the shoulders 110 and/or the walls 5 with a locking or tamper-resistant device (not shown) to prevent unauthorized removal.

In a preferred embodiment, the walls 5 have smooth portions 131 which have a smooth surface finish and are positioned above the shower floor portion 55 as shown in FIG. 4. The smooth portions 131 facilitate the passage of water from the walls 5 to the shower floor 55 and the trough 60. As shown in FIG. 3, the walls 5 and ceiling 15 of the bathroom module 2 are reinforced by reinforcing sheets 133. In a preferred embodiment, the reinforcing sheets 133 are adhesively bonded to the walls 5 and the ceiling 15. Studs 134 are fastened to the exterior of the reinforcing sheets 133 in a conventional manner to increase the rigidity of the bathroom module 2 and to provide structure to which the existing building structure (not shown) surrounding the bathroom module may be connected.

The ceiling 15 is further strengthened with a top plate 17 which is fastened to the reinforcing sheets 133 positioned above the ceiling. In a preferred embodiment, the reinforcing sheets 133 are gypsum board and the studs are standard wooden 2×4's. Accordingly, the building structure (not shown) surrounding the bathroom module 2 may be easily connected to the module with bolts, threaded screws, nails, or other known methods. In alternate embodiments, other building materials known to those skilled in the art, such as plywood and laminated beams, are substituted for gypsum board and 2×4's, respectively.

Although the bathroom modules 2 illustrated herein include four walls 5, alternate embodiments of the bathroom module have fewer walls. For example, bathroom modules designed for installation in the corner of a building may have three walls. Other embodiments having fewer or more than four walls are used where required by the surrounding structure or aesthetic considerations.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A prefabricated bathroom module, comprising;

a floor having first and second floor sections, the second floor section being adapted to have liquid thereon, the second floor section being inclined toward the first floor section to direct the liquid toward the first floor section;

a wall connected to and extending away from the floor, the wall and floor defining an interior area;

at least one bathroom fixture within the interior area;

an elongated drainage trough intermediate the first and second floor sections and positioned for collecting the liquid from the second floor section and substantially preventing the liquid from moving between the first and second floor sections, the drainage trough having an aperture therethrough and being integrally connected to the first and second floor sections, the drainage trough and the first and second floor sections being integrally formed to define a continuous surface and being movable together as a unit;

a bridge extending between the first and second floor sections above the drainage trough and positioned to allow the liquid to move from the second floor section into the drainage trough, the bridge being positioned to permit passage of a wheeled assembly thereover between the first and second floor sections; and a drain connected to the drainage trough for removing the liquid from the drainage trough.

2. The bathroom module of claim 1 wherein the first floor section is substantially horizontal.

3. The bathroom module of claim 1 wherein the second floor section is inclined at a grade of approximately 2% relative to horizontal.

4. The bathroom module of claim 1 wherein the second floor section is inclined at a grade in the range of approximately 1% to 4%, inclusive, relative to horizontal.

5. The bathroom module of claim 1 wherein the fixture is a shower fixture positioned above the second floor section and adapted to direct the liquid toward the second floor section, the second floor section and wall defining a shower area within the interior area.

6. The bathroom module of claim 1 wherein the first and second floor sections each have an edge adjacent to the drainage trough, each edge having a length, the drainage trough extending along the entire length of the edges.

7. The bathroom module of claim 1, further comprising a ceiling spaced above the floor and integrally connected to an upper edge of the wall, the wall being integrally connected to the floor.

8. The bathroom module of claim 1 wherein each of the first and second floor sections has an upper floor surface and the bridge has an upper bridge surface that is substantially flush with the upper floor surface of one of the first and second floor sections.

9. The bathroom module of claim 1 wherein the bridge is a grate.

10. The bathroom module of claim 1 wherein the drainage trough has a first sidewall portion, a second sidewall portion opposite the first sidewall portion and a base portion extending between the first and second sidewall portions, the first sidewall portion has a first shoulder portion and the second sidewall portion has a second shoulder portion spaced apart from the first shoulder portion, each of the first and second shoulder portions having a support surface that supports the bridge thereon in a position spaced apart from the base portion.

11. The bathroom module of claim 10 wherein the support surfaces of the first and second shoulder portions are substantially coplanar.

12. The bathroom module of claim 1 wherein the drainage trough has first and second portions that each extend downwardly toward the aperture so as to direct the liquid in the respective first and second portions toward the aperture.

13. The bathroom module of claim 1 wherein the bridge is removable for access to the drainage trough and drain.

14. A prefabricated bathroom module of the type for receiving wheeled assemblies therein, comprising:

a plurality of walls including first and second opposing and spaced-apart walls;

a floor having a first floor portion with a first upper surface, a second floor portion with a second upper surface inclined toward the first upper surface at a grade in the range of approximately 1%–4%, inclusive, and adapted to have liquid thereon, each floor portion extending between and connected to the first and second walls, and a trough portion intermediate the first and second floor portions integrally formed with the first and second floor portions to define a continuous surface and extending between and connected to the first and second walls for collecting the liquid from the second floor portion and substantially preventing the liquid from moving between the first and second floor portions, the trough portion having a first sidewall portion, a second sidewall portion opposite the first sidewall portion and a base portion extending between the first and second sidewall portions, the first sidewall portion having a first shoulder portion and the second sidewall portion having a second shoulder portion spaced apart from the first shoulder portion, each of the first and second shoulder portions having a support surface, the base portion having an aperture therethrough, the floor and the plurality of walls defining an interior area;

a grate having a grate lower surface and a grate upper surface, the grate lower surface resting on the shoulder portion support surfaces and facing the base portion, the grate upper surface being substantially flush with the first upper surface of the first floor portion and the second upper surface of the second floor portion for permitting passage of a wheeled assembly over the grate between the first and second floor sections, the grate being positioned to allow the liquid to move from the second floor portion into the trough;

at least one bathroom fixture within the interior area; and a drain connected to the aperture for removing the liquid from the trough portion.

15. The bathroom module of claim 14, further comprising a ceiling wherein the plurality of walls are integrally connected to the floor and the ceiling, and the first and second floor portions are integrally connected to the trough.

16. A prefabricated bathroom module of the type for receiving a wheeled assembly therein, comprising:

a floor having an upper surface and first and second floor sections, the second floor section being adapted to have liquid thereon, the second floor section being inclined toward the first floor section to direct the liquid on the second floor section toward the first floor section;

a plurality of walls connected to and extending away from the floor, the walls being interconnected to form an interior area;

at least one bathroom fixture within the interior area;

a trough intermediate the first and second floor sections and positioned for collecting liquid from the second floor section and substantially preventing the liquid from moving between the first and second floor sections, the trough having an aperture therethrough and being integrally molded with the wall and the first and second floor sections in a single lay-up, the trough, the wall, and the first and second floor sections being movable together as a unit;

bridge means extending between the first and second floor sections above the trough and positioned to allow the liquid to move from the second floor section into the trough;

support means for supporting the bridge means above the aperture and substantially flush with the upper surface of the floor for permitting passage of wheeled assemblies over the bridge means between the first and second floor sections; and a drain connected to the trough at the aperture for removing the liquid from the trough.

17. The bathroom module of claim 16 wherein the bridge means is a grate.

18. The bathroom module of claim 16 wherein the trough has a first sidewall portion, a second sidewall portion opposite the first sidewall portion and a base portion extending between the first and second sidewall portions, the support means comprising a first shoulder portion projecting outwardly from the first sidewall portion and a second shoulder portion spaced apart from the first shoulder portion and projecting outwardly from the second sidewall portion, each of the first and second shoulder portions having a support surface that supports the bridge means thereon in a position spaced apart from the base portion.

19. The bathroom module of claim 16 wherein the fixture is a shower fixture positioned in one of the plurality of walls above the second floor section and adapted to direct the liquid toward the second floor section, the second floor section and the one of the plurality of walls defining a shower area within the interior area.

* * * * *